US005987648A

United States Patent [19]

Boyd

[11] Patent Number: 5,987,648

[45] Date of Patent: Nov. 23, 1999

[54] CAP FOR CATCHING BALLS

[76] Inventor: Stan Boyd, 10121 Conejo La., Santee, Calif. 92071

[21] Appl. No.: 09/079,134

[22] Filed: May 14, 1998

[51] Int. Cl.[6] ..... A42B 1/06

[52] U.S. Cl. ..... 2/195.1; 2/171.6; 2/209.12; 2/209.13; 2/209.3

[58] Field of Search ..... 2/171.4, 171.5, 2/171.6, 173.5, 181, 181.2, 181.4, 195.1, 195.2, 209.12, 209.13, 209.3, 209.5, 209.7

[56] References Cited

U.S. PATENT DOCUMENTS 2,597,447 5/1952 Bruns .
4,628,543 12/1986 Hunt .
4,768,232 9/1988 Villalobos .
4,829,600 5/1989 Courtney .
5,542,129 8/1996 Munoz .
5,742,944 4/1998 Pfefferman ..... 2/209.12

*Primary Examiner*—Diana Oleksa
*Attorney, Agent, or Firm*—Thomas J. Tighe

[57] ABSTRACT

A cap has a visor and a hole defined by its crown. The hole communicates with a pocket that extends from the hole external to the crown. The hole and pocket are sized to easily accommodate a ball to be caught, e.g. a baseball. A ball flying into the crown will be funneled by the crown through the hole and into the pocket to be trapped therein. The pocket prevents the ball from bouncing out of the cap's crown. The pocket can be folded and fastened against the crown, or concealed inside the crown, to give the cap a conventional appearance. The visor has a grip affixed to it to help a wearer securely grip the visor while trying to catch a flying ball in the crown's pocket. The force of a ball being caught releases the pocket and causes it to unfold, trapping the ball.

6 Claims, 3 Drawing Sheets

CAP FOR CATCHING BALLS

BACKGROUND OF THE INVENTION

This invention relates in general to baseball caps, and in particular to caps designed to also catch baseballs.

Visored sporting caps commonly worn by baseball fans, hereafter generally referred to as "baseball caps" are quite common. Such caps have a visor which shields glaring lights or sunlight from a wearer's eyes. The cap of this invention may be worn wherever baseball caps in general are used but is particularly useful for catching foul balls and home runs while watching baseball games.

Many people attend baseball games with the hope of catching a baseball as a souvenir. To do so, some spectators bring their own baseball gloves. However, it is rare to have a ball hit in one's direction close enough to catch, so carrying a glove is essentially a burden. It must be held or placed on a person's lap, and there is always a risk that it may be lost or taken.

The idea of using a hat or a sporting cap for catching a baseball is not new. Additionally, some prior hats have glove-like attachments secured to the top or crown portion of the hat. These glove-like adaptations allowed a user to insert his or her hand into the glove-like section to catch a ball. Some include pockets for the insertion of padding to help cushion the impact when the ball is caught. However these hats have certain disadvantages, such as an appearance different from the standard sporting cap, appearances that are strange and undesirable. Additionally, it is not always easy to insert a person's hand into a glove section and it forces the person to momentarily take his or her eyes off the flight of the ball. Also, there was insufficient cushioning for the ball's impact. For these and other reasons, these types of ball-catching hats have not become popular.

The cap of this invention has features to allow it to be used to catch a baseball, or other ball, but these features do not detract from its appearance or normal use as a baseball style cap. Since the cap has a normal appearance, it can be un-embarrassingly be worn throughout a game and is therefore less likely to be lost.

Other advantages and attributes of this invention will be readily discernible upon a reading of the text hereinafter.

SUMMARY OF THE INVENTION

An object of this invention is to provide a conventional looking, baseball-style cap which has additional features for catching and trapping a ball, especially a baseball.

An additional object of this invention is to provide a cap for catching balls having an expandable ball-trapping pocket.

An additional object of this invention is to provide a cap for catching balls which has a handle on the visor for more secure gripping.

A further additional object of this invention is to provide a cap for catching balls which has a handle on the visor which provides a visible location for displaying names, trademarks or logos.

These objects, and other objects expressed or implied in this document, are accomplished by a cap having a crown and visor, for catching balls, the cap including: a hole defined by the crown being large enough for a ball to easily pass through it; a pocket, affixed to the crown and circumscribing the hole, for trapping a ball that passes through the hole, the pocket being foldable when not in use to give the cap a conventional appearance; and a fingerhold affixed to the visor for gripping the visor to hold the cap in a position to catch a ball. In a first embodiment disclosed herein, the cap has a flap, pivotally affixed along a front margin of the flap to a front of the crown. The flap covers the hole and partially defines the pocket, the flap being conformable to the shape of the crown when it is pivoted against the crown. A skirt, extending between the flap and the crown around the hole completes the definition of the pocket, the skirt means being foldable, when not in use, underneath the flap. The first embodiment also includes a fastener, e.g. a hook and loop fastener for releasably holding the flap in conformance against the crown when the pocket is not extended carrying a ball. In a second embodiment the hole and pocket are defined by a centrally disposed, stocking-like extension of the crown, the extension being foldable when not being used to trap a ball in order to give the cap a conventional look. In a third embodiment the cap further includes an adjustable belt at the rear of the crown for adjusting its circumference, and the hole for catching the ball is a gap between the material of the crown and the adjustable belt, and the pocket extends outwardly from, and encompasses, the gap. The pocket can be tucked back through the gap to be hidden under the crown in order to give the cap a more conventional look.

DESCRIPTION OF THE PREFERRED EMBODIMENT

Figure 1:
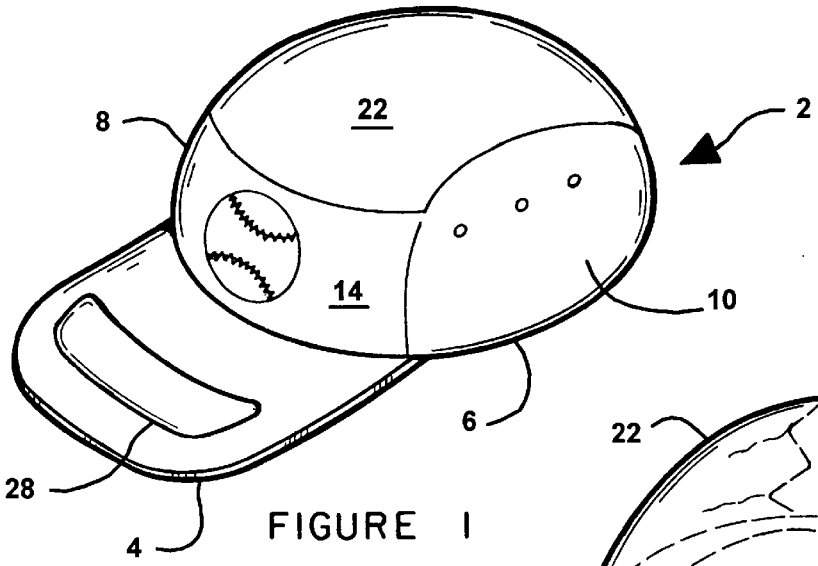
FIG. 1 is a pictorial view of the cap of this invention.
Figure 2:
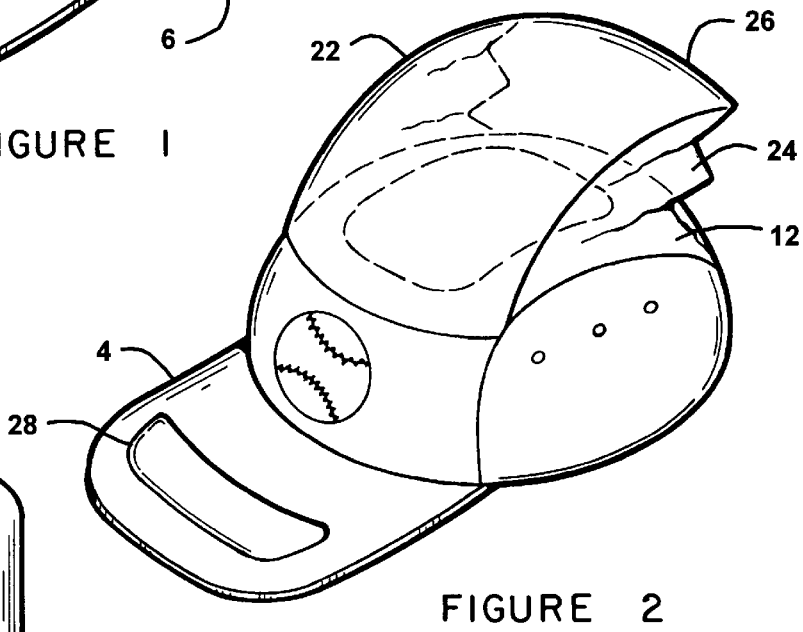
FIG. 2 is a pictorial view of the cap with an accordion-folded pocket partly expanded.
Figure 3:
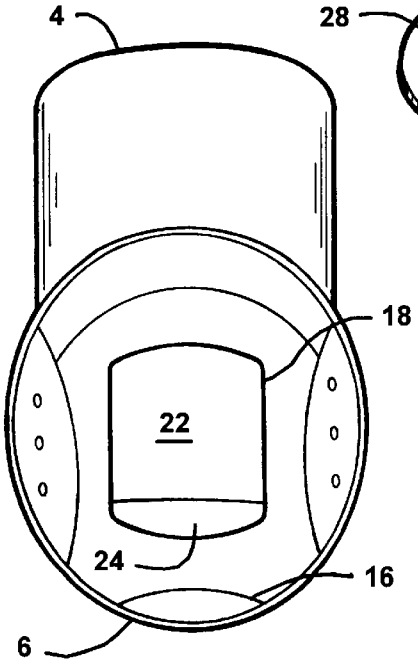
FIG. 3 is a bottom view of the cap of FIG. 2.

Referring to FIGS. 1–4, a sporting or baseball cap, generally designated 2, has a bill or visor 4 attached to the lower margin, or brim 6, of the front (an arbitrarily chosen directional reference, corresponding to the side to which the visor is attached) of the crown 8, which generally conforms to and fits on a wearer's head. The cap is generally fabricated from sewn-together fabric panels in a variety of styles. As illustrated, the cap shown has side panels 10, top panels 12 and a front panel 14. Names, trademarks and logos can be placed on the front panel where they would be highly visible. Parts of the cap, such as the visor and the front panel, may be made stiffer by reinforcing material. The brim 6 is generally a band of stiffened fabric or plastic and usually has provision (not shown) for adjusting the brim's size at the rear of the cap. Generally, the top panel is cut away at the rear brim adjustment location, leaving a gap 16 near the adjustment location.

Referring again to FIGS. 1–4, the cap has a hole 18 defined by the top panels of the cap, located preferably at what would be the cap's peak. The hole is sufficiently large enough to allow a ball, such as a baseball 20, to easily pass through. A pivotable flap 22, attached to the outside of the crown, covers the hole. The front edge of the flap is connected to the visor side of the hole, preferably along a seam between the front and the top panels. Depending on the design of the cap, the flap could also be connected at the front of the crown where it joins the visor. The flap has a generally curved polygon shape, with an area sufficient to cover the hole 18 in the top panel. The flap is preferably made from a flexible fabric of the same type used for the other panels in the construction of the crown of the cap.

Referring again to FIGS. 1–4, a foldable skirt 24 extends between the flap 22 and the top panel 12. The flap and the skirt together define a pocket 26 circumscribing the hole 18 in the top panel. The skirt is preferably made from a flexible fabric or netting material and has, or can be folded into, a plurality of accordion like creases to collapsibly fold it down onto the crown of the cap. The folds of the skirt are preferably to the inside of the flap so that when the flap is down against the crown, the skirt's folds are hidden beneath the flap. When the flap is down in its normal position it has the general appearance of a top panel of a conventional cap. Releasable fasteners (not shown), e.g. hook and loop fasteners or magnets, can be used to releasably hold the flap against the top panel. Also, the flap can be made long enough to cover a gap, if any, between the rear margin 16 of the crown material and the brim at the rear of the cap, where the brim's adjustment feature is generally located. Covering this area can improve the general appearance and function of the cap.

Referring again to FIGS. 1–4, a finger grip handle 28 is affixed to the upper surface of the visor, oriented perpendicular to the longitudinal axis (front to back) of the cap. The handle is preferably a strap affixed at its ends and along its front edge to the visor. The ends of the strap are preferably radiused from its front edge thus bowing the strap to create a pocket between the strap and the visor, a pocket which opens toward the crown. A user can insert his or her fingers into this pocket and place an opposing thumb on the opposite side of the visor to hold the cap securely enough to prevent the impact of a fly ball from yanking the cap from the user's grasp. The handle is not limited to any particular materials but must have sufficient strength to resist breaking or tearing under its intended use. Preferably the handle is made of the same material as the visor. Also, the handle can be made wide enough to allow the placing of names, trademarks or logos on its top surface which, because of its raised rear edge, makes them visible to others. The pocket can also be made large enough to hold or contain items, such as glasses.

Figure 4:
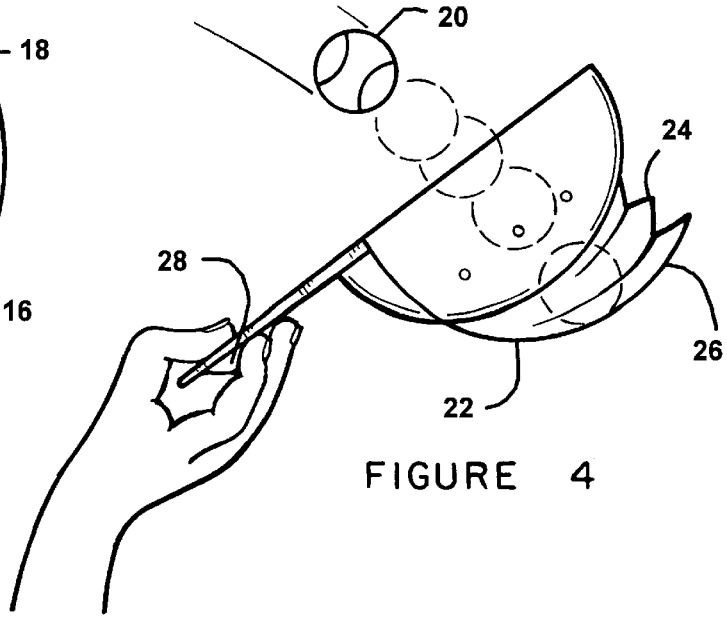
FIG. 4 is a pictorial view of the cap of FIG. 2 being used to catch a ball.
Figure 5:
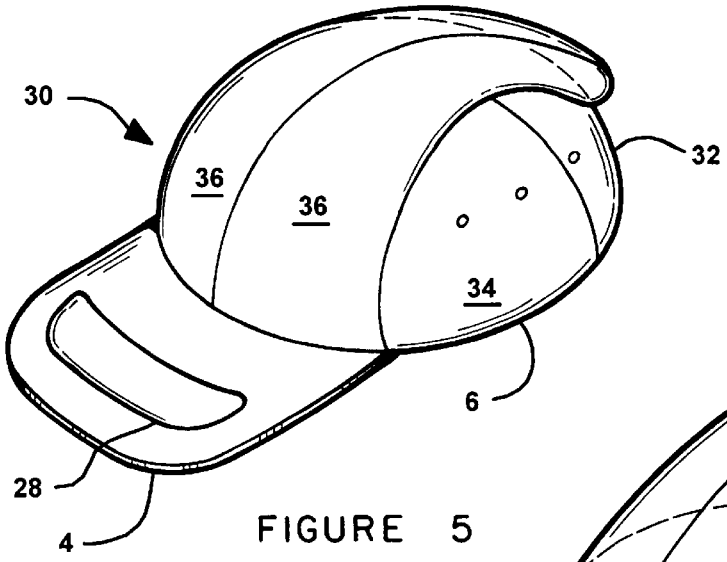
FIG. 5 is a pictorial view of a second embodiment of a cap for catching balls.
Figure 6:
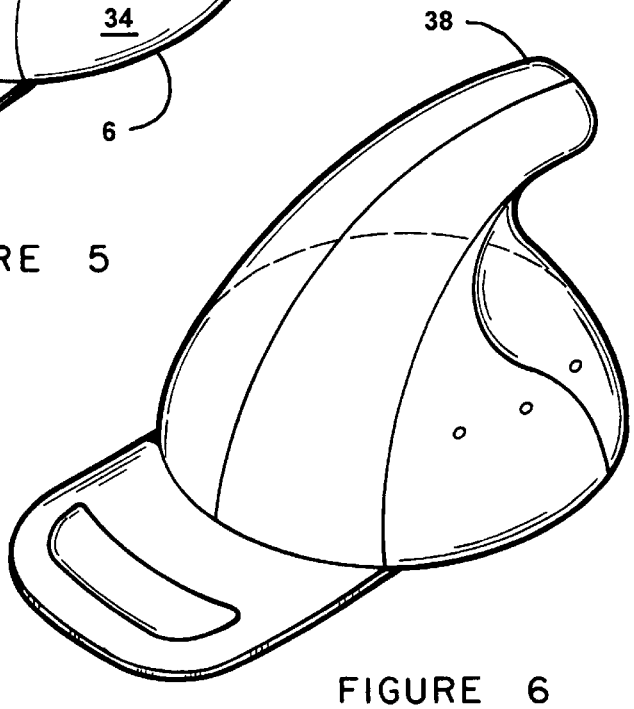
FIG. 6 is a pictorial view of the second embodiment showing a previously folded pocket extending from the crown.
Figure 7:
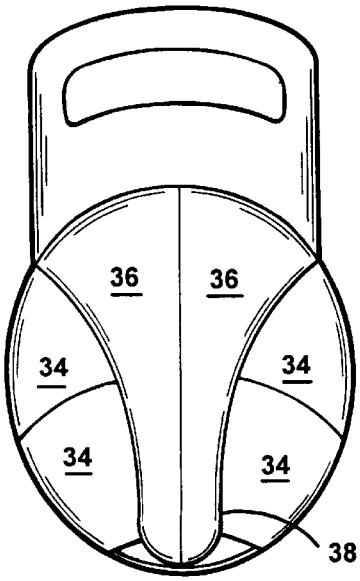
FIG. 7 is a top view of the second embodiment.
Figure 8:
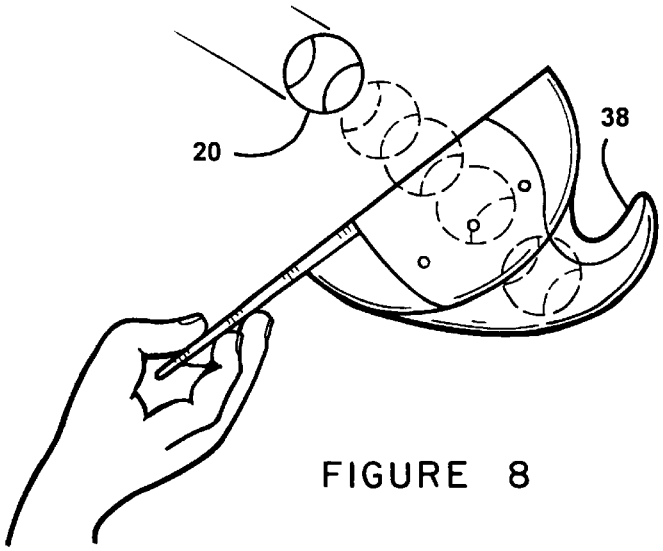
FIG. 8 is a pictorial view of the second embodiment being used to catch a ball.
Figure 9:
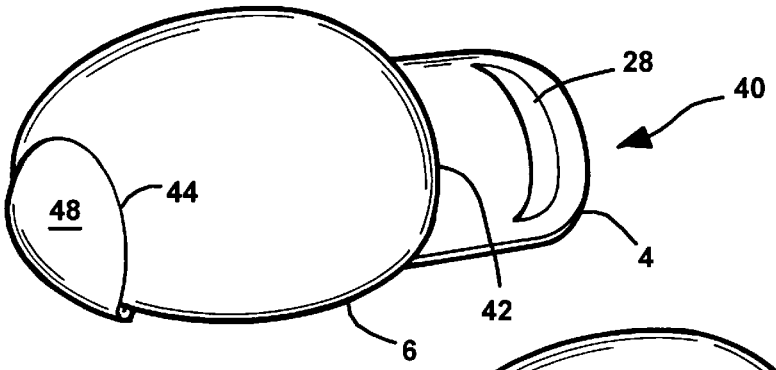
FIG. 9 is a pictorial view of a third embodiment.
Figure 10:
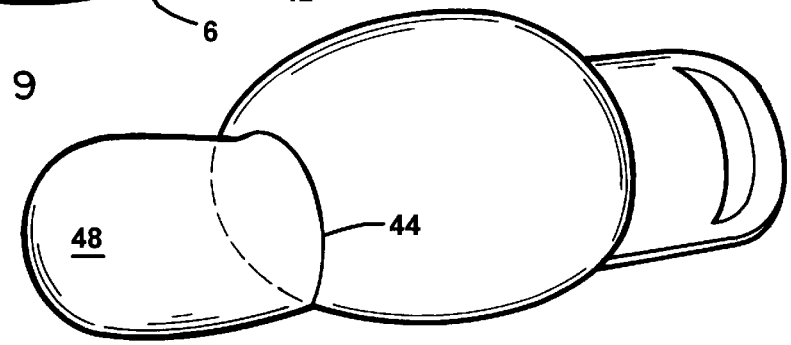
FIG. 10 is a pictorial view of the third embodiment showing a previously folded pocket extending from the rear of the cap.
Figure 14:
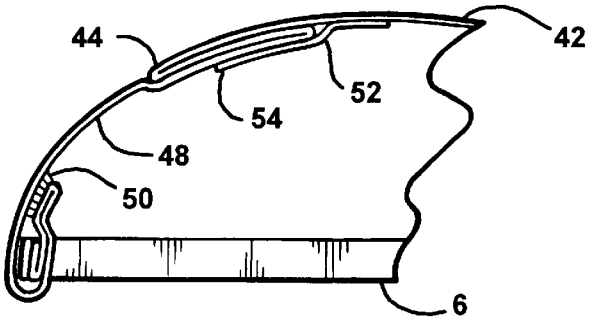
FIG. 14 is a partial cross-sectional view taken at line 14—14 in FIG. 13.
Figure 11:
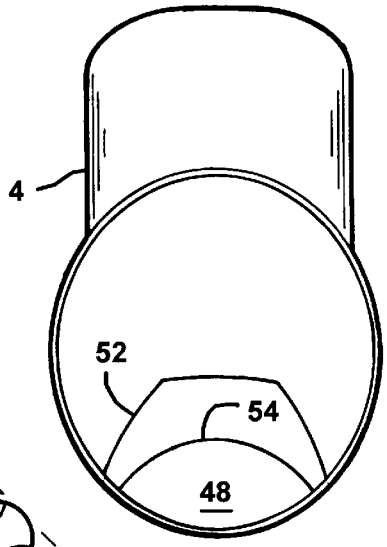
FIG. 11 is a bottom view of the third embodiment.
Figure 13:
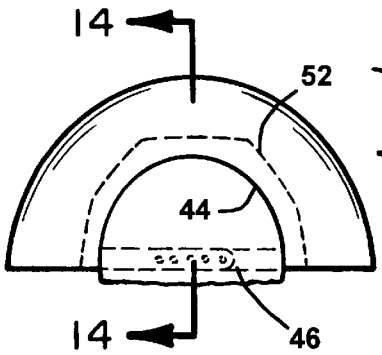
FIG. 13 is rear elevational view of the third embodiment.
Figure 12:
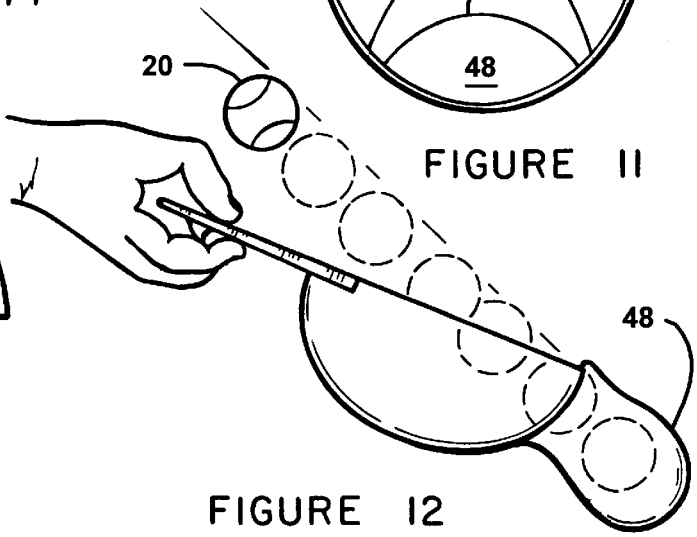
FIG. 12 is a pictorial view of the third embodiment being used to catch a baseball.

Referring to FIG. 4, the cap can be used at a sporting event, such as a baseball game, as any sporting cap would, to cover the user's head and shield his eyes from the sun or glare. However, in the event a baseball 20 is hit toward the user, he or she can quickly remove the cap by grasping the front of the visor 4, and with fingers inserted into the pocket of the handle 28, the wearer can position the cap to catch the ball. The cap is held in a generally inverted position so that the ball passes through the hole in the crown impacting the flap 22 and causing it to be released and pivot downwardly away from the crown. As the flap pivots, the skirt 24 will also expand, together forming a pocket 26 where the ball is trapped and held. If the ball does not initially hit the hole, it will be funnelled by the concave shape of the inside of the crown into the hole and pocket formed by the extended flap and skirt. Once trapped in the pocket, the ball is less apt to be dropped or jarred loose by other fans trying to get the ball.

Referring to FIGS. 5–8, a second embodiment of the cap, generally designated 30, has a bill or visor 4 attached to the lower margin, or brim 6, of the front of the crown 32 which generally conforms to and fits on the wearer's head. This style is similar to the more conventional baseball style cap where the crown is formed by a plurality of generally triangular shaped panels. In this embodiment, the side panels 34 and the front panels 36 are generally triangular shaped, but have legs that are considerably longer than their bases. The panels are stitched together at their leg edges to form the crown of the cap, which conforms to the wearer's head at the brim. However, because of the extended shape of the panels, their joining forms a narrowing pocket 38 near their uppermost ends. The design of the panels is such that they can be folded to form a crown conforming to the wearer's head with the pocket folded to the rear and conforming to the general shape of the crown. In this fashion, the front panels 36 generally extend from the front, at the seam with the visor, over the top of the cap to the rear, near the brim. The panels are made of a flexible fabric similar to those used in other baseball caps. The cap is normally worn with the pocket in the folded position, giving the cap the appearance of a typical baseball cap.

Referring to FIGS. 5–8, a handle 28 can be attached to the visor as in the preferred embodiment for use in holding the cap when catching a ball, and for displaying a name, trademark or logo. As in the preferred embodiment, to catch a ball 20 the cap is grasped by the visor with the fingers inserted into the pocket between the handle and the visor, with the thumb holding the opposite side of the visor. The cap is held so that the ball falls into the upturned, concave surface of the crown. The impact of the ball onto the inside surfaces of the panels causes the pocket 38 to unfold, allowing the ball to be funnelled into the narrowing pocket where it is trapped and held.

Referring to FIGS. 9–14, a third embodiment of the cap is shown and generally designated 40. A bill or visor 4, as in the other embodiments, is attached to the lower margin or brim 6 of the front of the crown 42, which generally conforms to and fits on the wearer's head. This embodiment can be used in various styles of caps, including the baseball style having a crown formed of generally triangular panels, and a bicycle style having a crown formed of side and top panels. In this embodiment, a gap is defined in the rear of the cap between a semicircular rear edge 44 of the crown and an adjustment band 46 (shown in dotted lines in FIG. 13). The gap is large enough for a baseball to easily pass through. An expandable pocket 48 is connected around the hole preferably by releasable fasteners, such as hook and loop fasteners 50. The pocket is preferably a flexible fabric formed into a stocking like shape. A pocket retainer 52, a strip of fabric attached at its front and sides to the inside surface of the crown, has a lip 54 at its rear which is concentric with the rear edge of the crown 44. The pocket 48 is normally tucked under the pocket retainer, between the inside surface of the crown and the lip 54 of the pocket retainer. When the pocket is tucked away, the cap has the normal appearance of a baseball cap. The pocket, normally the same color as the crown, appears to be just a part of the crown. It even covers the adjustment band so it has a more finished appearance.

Referring again to FIGS. 9–14, as in the other embodiments, a handle 28 can be attached to the visor 4 for use in holding the cap when catching a ball, and for displaying a name, trademark or logo. As with the other embodiments, to catch a ball 20, the cap is grasped by the visor 4 with the fingers inserted into the pocket between the handle and the visor, with the thumb holding the opposite side of the visor. The cap is held so that the ball falls into the upturned, concave surface of the crown. The impact of the ball into the inside of the crown deflects it toward the rear of the cap where it pushes the pocket 48 outward. The pocket expands from the force of the ball pushing it, becoming unfolded from under the lip 54 of the pocket retainer 52. The expanded pocket traps the ball and holds it. As with all the embodiments, with practice a user can quickly develop the skill for holding the cap to catch the ball in the pocket.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. For a cap having a crown, brim and visor, an improvement for catching flying balls comprising:

(a) the crown defining a hole, the hole being large enough for a flying ball to easily pass through it, (b) pocket means, affixed to the crown and circumscribing the hole, for trapping a ball that passes through the hole, the pocket means being foldable when not in use to give the cap a conventional appearance, and (c) a fingerhold affixed to the visor for gripping the visor to hold the cap in a position to catch a flying ball.

2. The cap according to claim 1 wherein the fingerhold for gripping comprises a pocket defined by a strip of material affixed to a top side of the visor.

3. The cap according to claim 1 wherein the hole is disposed at the rear of the crown.

4. The cap according to claim 3 further comprising an adjustment belt at the rear of the crown, and wherein the hole comprises a gap between a back margin of the crown and the adjustment belt.

5. The cap according to claim 3 further comprising:

(a) means for tucking the pocket means through the hole and inside the crown so as to hide the pocket means, and (b) means for releasably holding the pocket means in its tucked position.

6. The cap according to claim 3 wherein the fingerhold for gripping comprises a pocket defined by a strip of material affixed to a top side of the visor.

* * * * *